US008237617B1

(12) United States Patent
Johnson et al.

(10) Patent No.: US 8,237,617 B1
(45) Date of Patent: Aug. 7, 2012

(54) SURFACE WAVE ANTENNA MOUNTABLE ON EXISTING CONDUCTIVE STRUCTURES

(75) Inventors: Harold Wayne Johnson, Roach, MO (US); Timothy D. Euler, Leawood, KS (US)

(73) Assignee: Sprint Communications Company L.P., Overland Park, KS (US)

( * ) Notice: Subject to any disclaimer, the term of this patent is extended or adjusted under 35 U.S.C. 154(b) by 494 days.

(21) Appl. No.: 12/563,307

(22) Filed: Sep. 21, 2009

(51) Int. Cl.
*H01Q 13/00* (2006.01)

(52) U.S. Cl. ..... 343/785; 343/786; 343/905

(58) Field of Classification Search ..... 343/720, 343/785, 786, 905, 906; 333/34, 240
See application file for complete search history.

(56) References Cited

U.S. PATENT DOCUMENTS 1,989,466 A * 1/1935 Satterlee et al. ..... 370/486
2,559,613 A * 7/1951 Halstead ..... 725/81
2,685,068 A * 7/1954 Goubau ..... 333/240
2,921,277 A * 1/1960 Goubau ..... 333/240
3,201,724 A * 8/1965 Hafner ..... 333/240
3,491,291 A 1/1970 Walker
3,509,463 A * 4/1970 Woodward et al. ..... 455/39
3,566,317 A * 2/1971 Hafner ..... 333/240
4,743,916 A * 5/1988 Bengeult ..... 343/785

* cited by examiner

*Primary Examiner* — Michael C Wimer

(57) ABSTRACT

What is disclosed is a surface wave antenna configured to install on an electrically conductive structure. The surface wave antenna includes a first portion comprising a conductive element and an attachment element, and a second portion comprising a conductive element and an attachment element. The conductive element of the first portion and the conductive element of the second portion are configured to each form a conductive longitudinal portion of a horn receive element, and the attachment elements are configured to conductively couple the conductive elements together to form the horn receive element. The surface wave antenna also includes a dipole element comprising a first transmit element and a second transmit element. The surface wave antenna also includes a mounting element comprising a first dielectric mount and a second dielectric mount.

20 Claims, 5 Drawing Sheets

SURFACE WAVE ANTENNA MOUNTABLE ON EXISTING CONDUCTIVE STRUCTURES

TECHNICAL FIELD

Aspects of the disclosure are related to the field of communications, and in particular, surface wave antennas used in wireless communication systems.

TECHNICAL BACKGROUND

Wireless communication networks typically include wireless access nodes through which wireless communication devices communicate. Many times, the wireless communication devices are mobile, and move throughout areas of poor wireless communication coverage. In other examples, the wireless communication devices are located within buildings or other structures which can attenuate or degrade wireless communications between the wireless communication devices and the wireless access nodes.

Wireless repeaters can be employed to enhance the wireless communication coverage of wireless access nodes for wireless communication devices. The wireless repeaters often retransmit the wireless communications of wireless access nodes for better reception by wireless communication devices. Likewise, the wireless repeaters can also retransmit the wireless communications of the wireless communication devices for better reception by wireless access nodes. Some examples of repeater systems used inside of buildings include indoor distributed antenna systems (DAS), and can employ coax wiring or optical fiber connections between various elements of the DAS.

Unfortunately, it can be difficult and costly to install wireless repeater systems and the associated antenna structures and interconnections. For example, in buildings and other architectural structures, locating antennas and interconnect therein for use by wireless communication devices can require destruction or modification of existing architectural elements, such as walls, ceilings, or other architectural features. However, many buildings and other architectural structures already include conductive structures located throughout, such as pipes, conduits, and structural support elements.

Overview

What is disclosed is a surface wave antenna configured to install on an existing electrically conductive structure. The surface wave antenna includes a first portion of the surface wave antenna comprising a conductive element and an attachment element, and a second portion of the surface wave antenna comprising a conductive element and an attachment element. The conductive element of the first portion and the conductive element of the second portion are configured to each form a conductive longitudinal portion of a horn receive element, and the attachment element of the first portion and the attachment element of the second portion are configured to conductively couple the conductive element of the first portion to the conductive element of the second portion to form the horn receive element. The surface wave antenna also includes a dipole element comprising a first transmit element and a second transmit element, where the first transmit element is coupled by a first dielectric member internally to the first portion of the surface wave antenna and the second transmit element is coupled by a second dielectric member internally to the second portion of the surface wave antenna. The surface wave antenna also includes a mounting element comprising a first dielectric mount and a second dielectric mount, where the first dielectric mount is disposed internally to and radially from the conductive element of the first portion and the second dielectric mount is disposed internally to and radially from the conductive element of the second portion.

What is also disclosed is a surface wave antenna configured to install on an electrically conductive structure. The surface wave antenna includes a first portion of the surface wave antenna comprising a conductive element and an attachment element, and a second portion of the surface wave antenna comprising a conductive element and an attachment element. The conductive element of the first portion and the conductive element of the second portion are configured to each form a conductive longitudinal portion of a horn receive element, and the attachment element of the first portion and the attachment element of the second portion are configured to conductively couple the conductive element of the first portion to the conductive element of the second portion to form the horn receive element. The surface wave antenna also includes a dipole transmit element coupled by a dielectric member internally to the surface wave antenna. The surface wave antenna also includes a mounting element disposed internally to the horn receive element, where the mounting element is configured to attach the surface wave antenna to the electrically conductive structure, where the electrically conductive structure is disposed axially through the horn receive element, and where the mounting element is further configured to electrically isolate the horn receive element and the dipole transmit element from the electrically conductive structure.

What is also disclosed is a surface wave antenna configured to install on an electrically conductive structure. The surface wave antenna includes a first portion of the surface wave antenna comprising a conductive element and an attachment element, and a second portion of the surface wave antenna comprising a conductive element and an attachment element. The conductive element of the first portion and the conductive element of the second portion are configured to each form a conductive longitudinal portion of a horn receive element, where the attachment element of the first portion and the attachment element of the second portion are configured to conductively couple the conductive element of the first portion to the conductive element of the second portion to form the horn receive element. The surface wave antenna also includes a dipole transmit element coupled by a dielectric member internally to the surface wave antenna. The surface wave antenna also includes a mounting element disposed internally to the horn receive element, where the mounting element is configured to attach the surface wave antenna to the electrically conductive structure, where the electrically conductive structure is disposed axially through the horn receive element, and where the mounting element is further configured to electrically isolate the horn receive element and the dipole transmit element from the electrically conductive structure. The surface wave antenna also includes an input jack coupled to the dipole transmit element, where the dipole transmit element is configured to receive radio-frequency (RF) signals over the input jack from a transceiver for transmission of surface wave RF signals along the electrically conductive structure, and an output jack coupled to the horn receive element, where the horn receive element is configured to receive further surface wave RF signals over the electrically conductive structure for transfer to the transceiver over the output jack.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views. While several embodiments are described in connection with these drawings, the disclosure is not limited to the embodiments disclosed herein. On the contrary, the intent is to cover all alternatives, modifications, and equivalents.

DETAILED DESCRIPTION

Figure 1A:
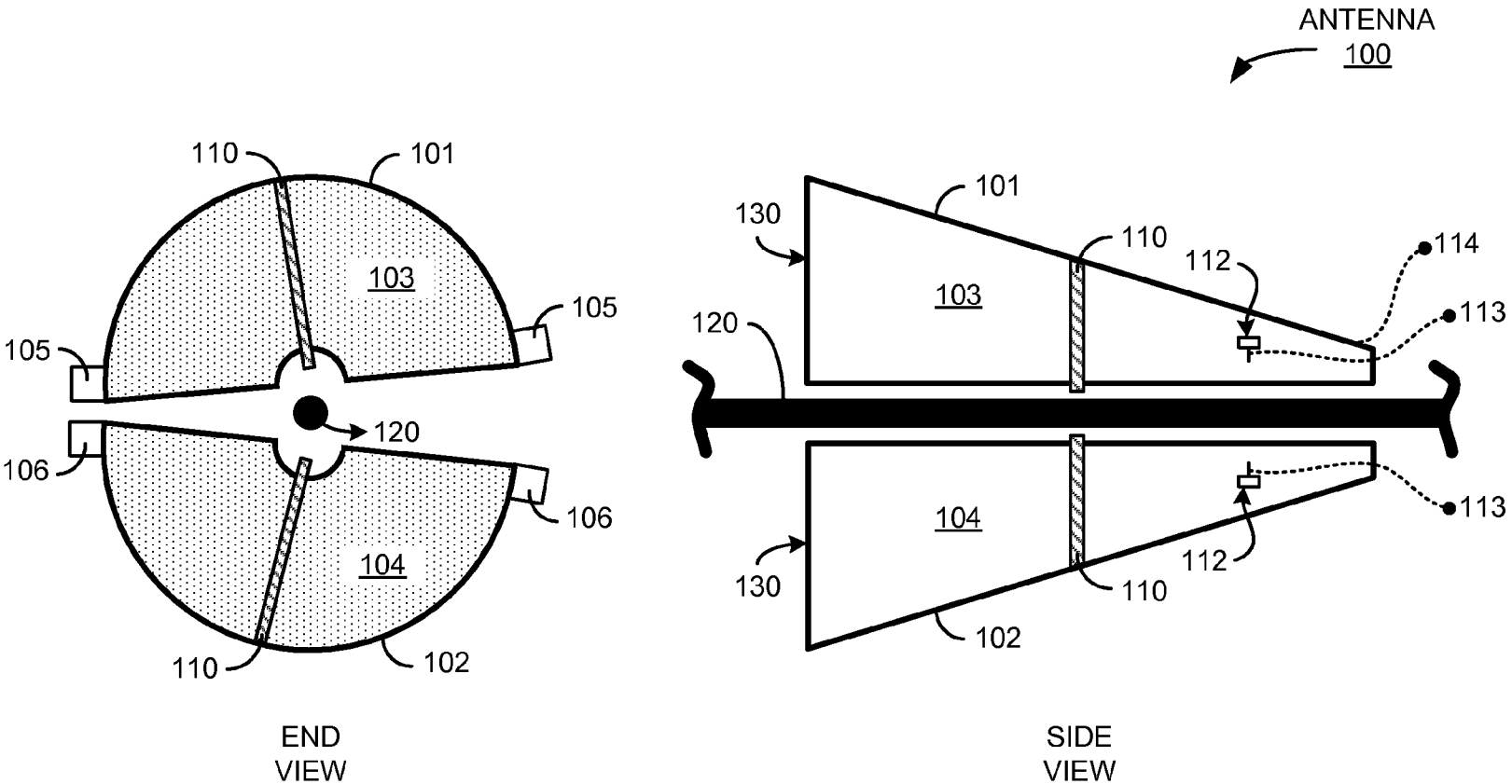
FIG. 1A is a schematic diagram in two views of a surface wave antenna.
Figure 1B:
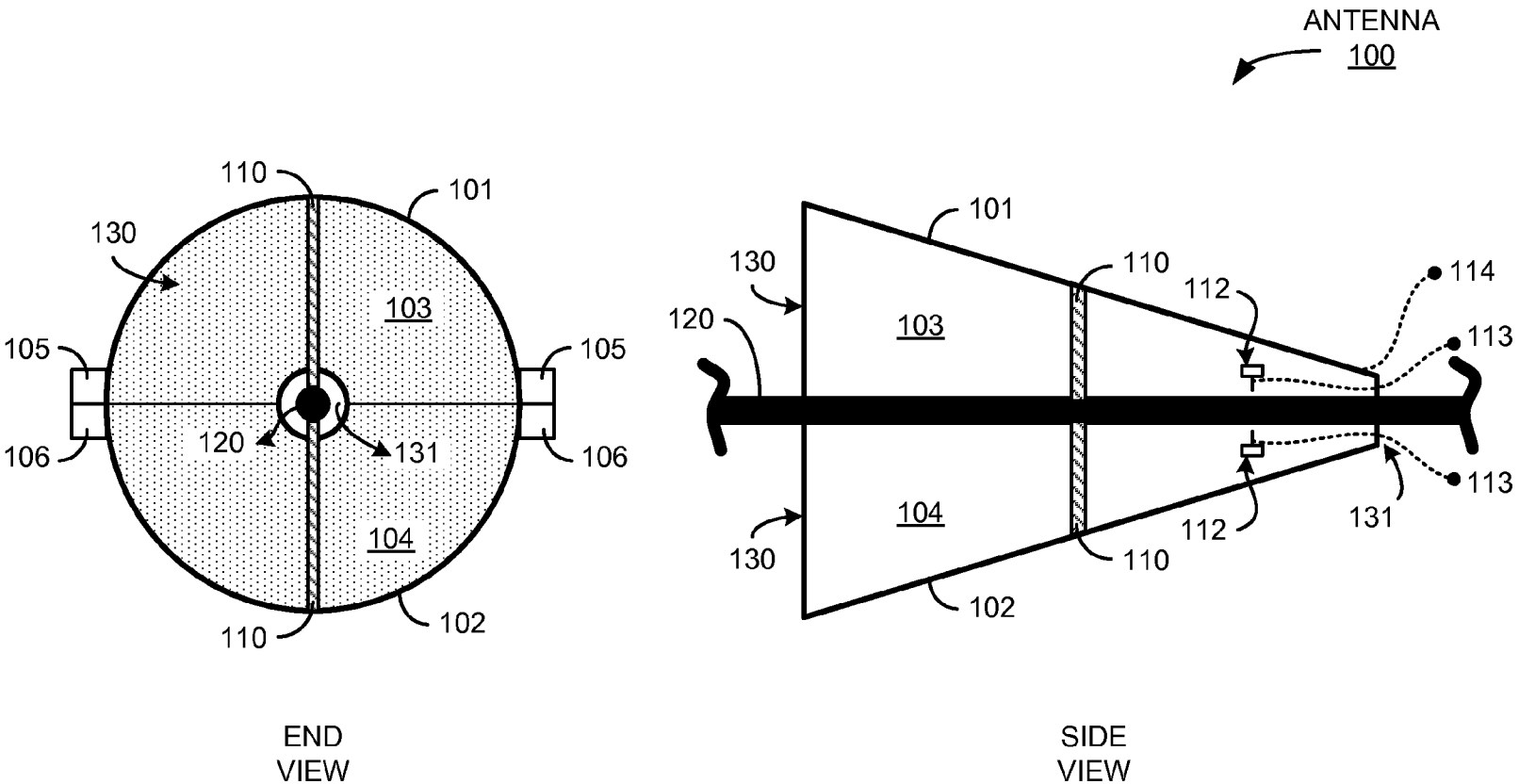
FIG. 1B is a schematic diagram in two views of a surface wave antenna.

FIG. 1A is a schematic diagram in two views of a surface wave antenna. As shown in FIG. 1A, an end view and a side view of antenna 100 are included. Antenna 100 includes first portion 101, second portion 102, mounting element 110, and dipole element 112. FIG. 1A illustrates antenna 100 prior to attachment around electrically conductive structure 120. FIG. 1B, in contrast, illustrates antenna 100 after attachment around electrically conductive structure 120.

First portion 101 includes conductive element 103 and attachment element 105. Second portion 102 includes conductive element 104 and attachment element 106. Attachment elements 105 and 106 are not shown in the side view in FIG. 1A for clarity. Conductive element 103 and conductive element 104 are configured to each form a conductive longitudinal portion of a horn receive element. Conductive elements 103 and 104 could be comprised of any conductive material, such as metal, sheet metal, or other conductive material. Conductive elements 103 and 104 could also be formed of dielectric materials and coated with a conductive substance, such as paint, or have conductive particles deposited thereon.

Attachment elements 105 and 106 are configured to conductively couple conductive element 103 and conductive element 104 together to form the horn receive element of antenna 100. In some examples, attachment elements 105 and 106 are conductive clips or fasteners used to hold conductive element 103 and conductive element 104 together. In other examples, one of attachment element 105 and 106 attach together for a pivotal coupling of conductive element 103 and conductive element 104 together on one longitudinal edge, while the other one of attachment element 105 and 106 are a latch or fastener to conductively couple conductive element 103 and conductive element 104 together on the other longitudinal edge. In pivotal coupling examples, a hinged operation similar to a clamshell could be achieved. When conductive element 103 and conductive element 104 are conductively coupled together by attachment elements 105 and 106, a horn receive element is formed. The horn receive element of antenna 100 is further detailed in FIG. 1B, as well as in other antenna examples shown in FIGS. 2 and 3.

Mounting element 110 includes two dielectric mounts in the example shown in FIG. 1A, although other configurations could be employed. The dielectric mounts couple first portion 101 and second portion 102 of antenna 100 to electrically conductive structure 120. In this example, the dielectric mounts are internal to and coupled radially from each of conductive elements 103 and 104. In some examples, the dielectric mounts could be fully dielectric or only include a dielectric portion to electrically isolate conductive elements 103 and 104 from electrically conductive structure 120. Examples of dielectric mounts include mounts configured to attach first portion 101 and second portion 102 of antenna 100 to electrically conductive structure 120 and electrically isolate first portion 101 and second portion 102 of antenna 100 from electrically conductive structure 120. The dielectric mounts of mounting element 110 could be constructed of wood, glass, plastic, cloth, air gaps, solid foam, gel, polytetrafluoroethylene (Teflon), or other dielectric or electrically isolating materials. Mounting element 110 could also include clamps, screw portions, fasteners which contact or penetrate electrically conductive structure 120, or other mounting devices for attaching antenna 100 to electrically conductive structure 120.

In further examples, the dielectric mounts of mounting element 110 each penetrate the associated conductive element 103 and 104 through a radial hole in the conductive element, and the dielectric mounts are also coupled to the conductive element through which each penetrates. Each radial hole could also comprise a threaded radial hole, and the dielectric mounts could be each configured to screw through the associated radial hole on the associated conductive element of the horn receive element to adjust a firmness of the attachment of the horn receive element to electrically conductive structure 120. In other examples, mounting element 110 includes a tightening portion or fastener coupled to at least one of the dielectric mounts to adjust a firmness of the attachment of the horn receive element to electrically conductive structure 120.

Dipole element 112 includes two transmit elements, in the example shown in the side view of FIG. 1A. The two transmit elements are not shown in the end view in FIG. 1A for clarity. In this example, each transmit element comprises a small conductive portion as shown by the small straight line portions of dipole element 112, and a dielectric member as shown by the square portions of dipole element 112. The transmit elements together comprise a dipole antenna in this example. In other examples, a different antenna configuration could be employed, such as directional antennas, coils, or other antenna configurations. The transmit elements of dipole element 112 could be formed from metal portions, wires, pins, or other conductive materials. Also in this example, the dielectric members electrically isolate the transmit elements from conductive elements 103 and 104 and couple the transmit elements internally to conductive elements 103 and 104. The dielectric members also position the transmit elements in close proximity to electrically conductive structure 120 when antenna 100 is attached to electrically conductive structure 120. In some examples, the dielectric members of dipole element 112 could be fully dielectric or only include a dielectric portion to electrically isolate the transmit elements from conductive elements 103 and 104. In further examples, the transmit elements of dipole element 112 are coupled to the dielectric mounts of mounting element 110, and the dielectric members of dipole element 112 could be integrated into the dielectric mounts of mounting element 110. Examples of the dielectric members of dipole element 112 include elements constructed of wood, glass, plastic, cloth, air gaps, solid foam, gel, polytetrafluoroethylene (Teflon), or other dielectric or electrically isolating materials. The dielectric members of dipole element 112 could also include clamps, screw portions, rivets, fasteners which contact or penetrate conductive elements 103 and 104, or other mounting devices for attaching the transmit elements of dipole element 112 to conductive elements 103 and 104.

Also shown in FIG. 1A is electrically conductive structure 120, as illustrated by a cylindrical member disposed between first portion 101 and second portion 102. It should be understood that electrically conductive structure 120 is typically of a length exceeding that of antenna 100, as indicated by the truncated cylindrical member representing electrically conductive structure 120. Electrically conductive structure 120 could comprise a conductive portion of an architectural element, and could include existing conductive structures, conductive structures where an open or accessible end is not available, or structures already embedded within architectural elements. For example, electrically conductive structure 120 could be a pipe or conduit in a building, a railing along a sidewalk or stairway, a structural support element of a building or bridge, a power transmission or distribution line, or other electrically conductive structure. In some examples, electrically conductive structure 120 is a generally hollow tube, while in other examples electrically conductive structure 120 is a generally solid structure.

In some examples, antenna 100 includes input conductor 113 and output conductor 114, although other configurations could be used. Input conductor 113 could be coupled to each of the transmit elements of dipole element 112, where the transmit elements are configured to receive radio-frequency (RF) signals over the associated input conductor for transmission of surface wave RF signals along electrically conductive structure 120. In some examples, each input conductor is terminated at an input jack for interfacing with coaxial cables or other input wires, where the input jack is dielectrically coupled to the horn receive element formed by conductive elements 103 and 104. In further examples, the dielectric mounts of mounting element 110 could protrude radially through or penetrate conductive elements 103 and 104 and could be hollow or include a hollow portion. Input conductors 113 could be routed through the hollow portion of the dielectric mounts of mounting element 110 to reach the transmit elements of dipole element 112. In some examples, an input jack is coupled to mounting element 110. Antenna 100 could also include output conductor 114 coupled to the horn receive element formed by conductive elements 103 and 104, where the horn receive element is configured to receive surface wave RF signals over electrically conductive structure 120 for exchange with the output conductor. In some examples, the output conductor comprises an output jack coupled to the horn receive element for interfacing with a coaxial cable or other output wire. In further examples, an input conductor or input jack coupled to the dipole transmit element is configured to receive RF signals from a transceiver for transmission of surface wave RF signals along electrically conductive structure 120, and an output conductor or output jack coupled to the horn receive element is configured to receive further surface wave RF signals over electrically conductive structure 120 for transfer to the transceiver.

FIG. 1B is a schematic diagram in two views of a surface wave antenna. As shown in FIG. 1B, an end view and a side view of antenna 100 are included. As with FIG. 1A, antenna 100 includes first portion 101, second portion 102, mounting element 110, and dipole element 112. FIG. 1A illustrates antenna 100 prior to attachment around electrically conductive structure 120. FIG. 1B, in contrast, illustrates antenna 100 after attachment around electrically conductive structure 120.

In FIG. 1B, first portion 101 and second portion 102 of antenna 100 have been attached to each other by attachment elements 105 and 106. Additionally, mounting element 110 has attached antenna 100 to electrically conductive structure 120. In this manner, conductive elements 103 and 104 of first portion 101 and second portion 102 form a horn antenna element disposed around electrically conductive structure 120. Thus, electrically conductive structure 120 is located axially through antenna 100. Also shown in FIG. 1B is a first end hole 130 and a second end hole 131 formed when first portion 101 and second portion 102 are joined by attachment elements 105 and 106. In this example, conductive elements 103 and 104 form a conductive conical shell with end holes 130 and 131 allowing for the axial penetration of electrically conductive structure 120.

In typical examples, mounting element 110 allows for attachment of antenna 100 to electrically conductive structure 120 while maintaining electrical isolation of conductive elements 103 and 104 from electrically conductive structure 120. Also in typical examples, when antenna 100 is attached to electrically conductive structure 120, the transmit elements of dipole element 112 are held in close proximity to electrically conductive structure 120, while maintaining electrical isolation between the transmit elements of dipole element 112 and electrically conductive structure 120.

Figure 2:
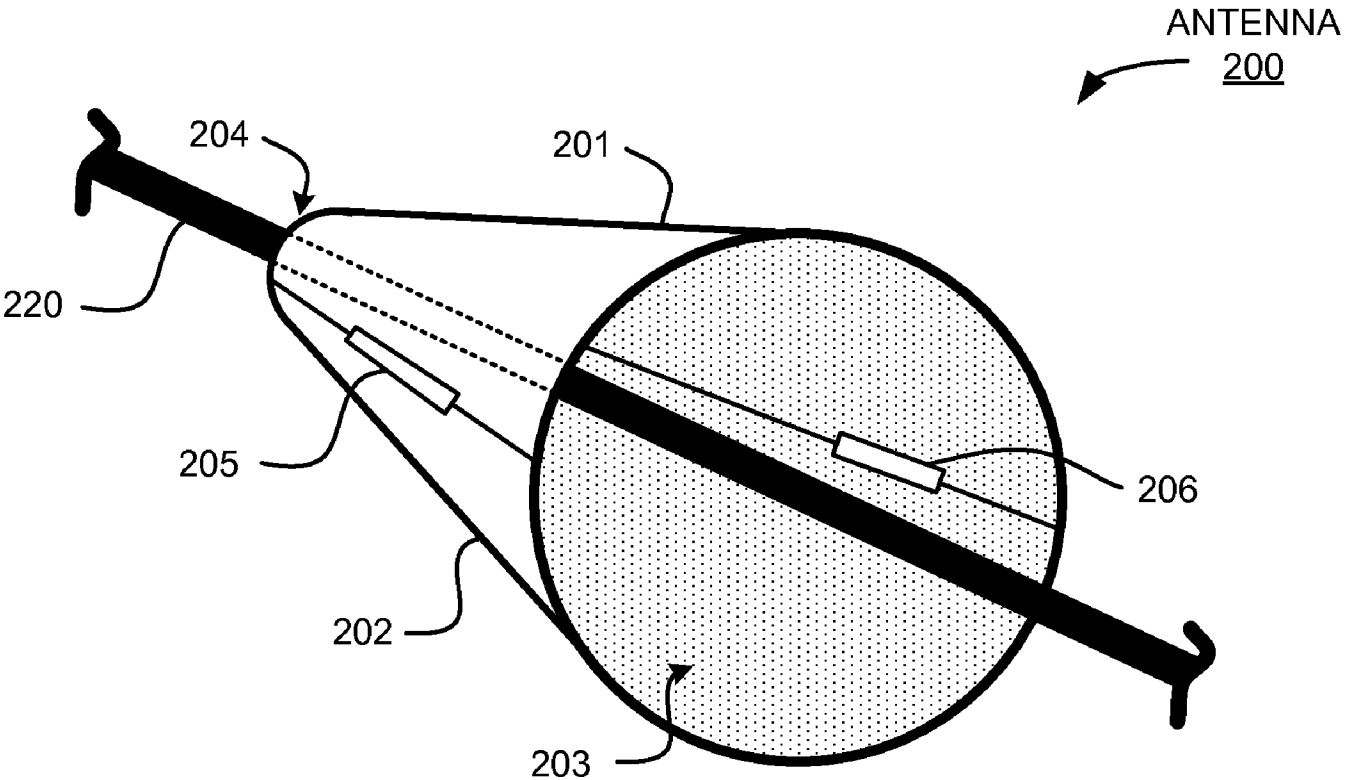
FIG. 2 is a perspective view of a surface wave antenna.

FIG. 2 is a perspective view of surface wave antenna 200. Surface wave antenna 200 includes first conic portion 201, second conic portion 202, hinge 205, and latch 206. Although not shown for clarity, surface wave antenna 200 could also include mounting elements for attaching surface wave antenna 200 around conductive pipe 220 as well as transmit antenna elements, such as a dipole antenna. In this example, first conic portion 201 and second conic portion 202 are attached on a first longitudinal edge by hinge 205, forming a clamshell which can pivot along hinge 205. First conic portion 201 and second conic portion 202 are also attached by latch 206 along a second longitudinal edge. Both hinge 205 and latch 206 allow for a conductive mating between first conic portion 201 and second conic portion 202 to form a horn antenna portion, while allowing for ingress and egress of conductive pipe 220 through the non-hinged edge formed in surface wave antenna 200. First conic portion 201 and second conic portion 202 are each formed of conductive material, similar to that discussed in FIG. 1A for first portion 101 and second portion 102 of antenna 100, although other configurations could be used. When disposed around conductive pipe 220, surface wave antenna 200 includes two end holes, a large end hole 203 and a small end hole 204. These end holes allow for axial penetration of conductive pipe 220 through the central hollow portion of surface wave antenna 200.

Figure 3:
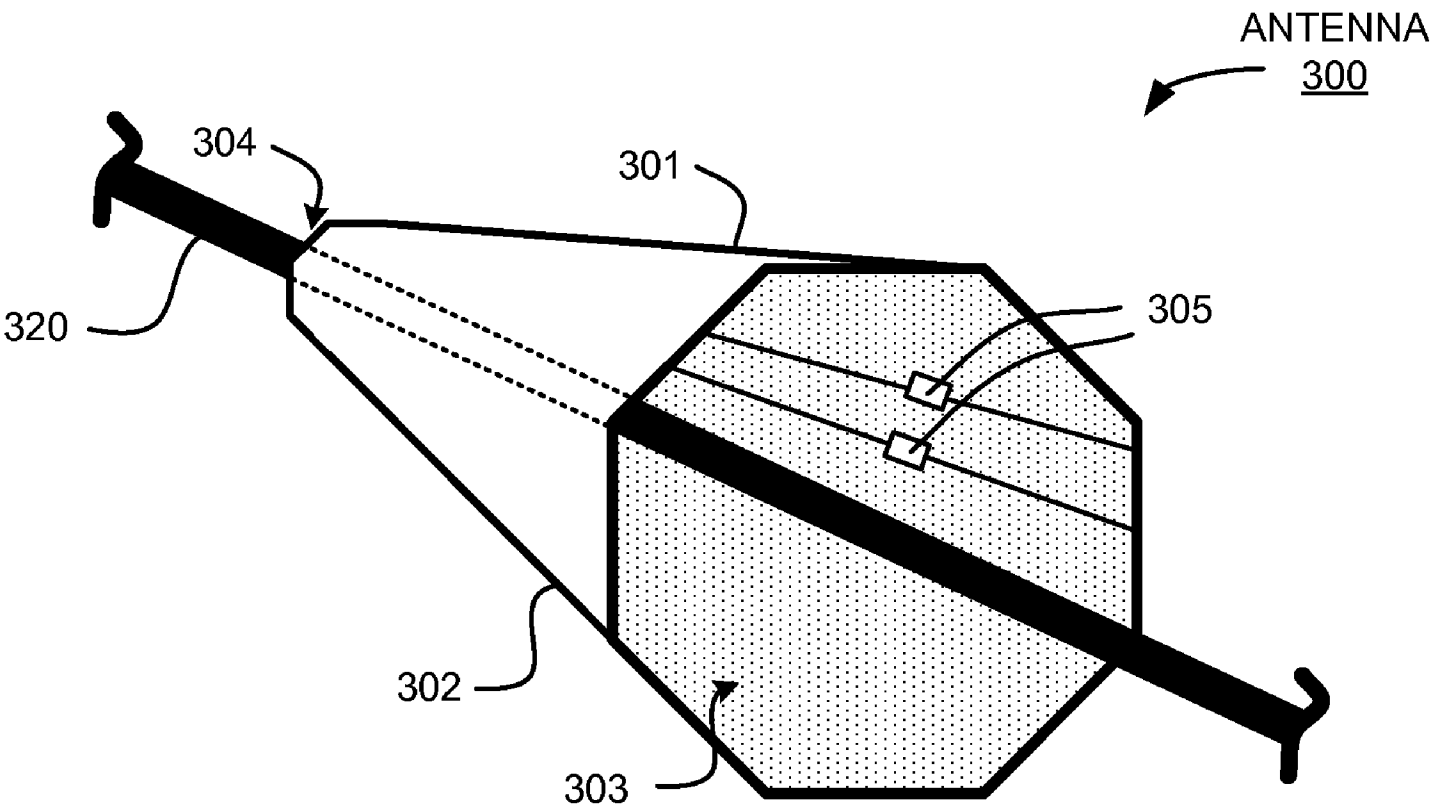
FIG. 3 is a perspective view of a surface wave antenna.

FIG. 3 is a perspective view of surface wave antenna 300. Surface wave antenna 300 includes hexagonal portion 301, closure member 302, and latches 305. Although not shown for clarity, surface wave antenna 300 could also include mounting elements for attaching surface wave antenna 300 around conduit 320 as well as transmit antenna elements, such as a dipole antenna. In this example, hexagonal portion 301 and closure member 302 can be attached together on their longitudinal edges by latches 305. Latches 305 allow for a conductive mating between hexagonal portion 301 and closure member 302 to form a hexagonal horn antenna portion, while allowing for ingress and egress of conduit 320 through the gap in hexagonal portion 301 when closure member 302 is not attached thereto. Hexagonal portion 301 and closure member 302 are each formed of conductive material, similar to that discussed in FIG. 1A for first portion 101 and second portion 102 of antenna 100, although other configurations could be used. When disposed around conduit 320, surface wave antenna 300 includes two end holes, a large end hole 303 and a small end hole 304. These end holes allow for axial penetration of conduit 320 through the central hollow portion of surface wave antenna 300, while being of a sufficient hole size to prevent electrical contact with conductive pipe 320.

In further examples, the central cavity formed by the horn antenna portion of antenna 100, surface wave antenna 200, or surface wave antenna 300 could be filled with a dielectric fill material. This dielectric fill material could allow for attachment and mechanical stabilization of the antenna over an electrically conductive structure, as well as having transmit antenna elements embedded therein. The dielectric fill material could be deposited onto each internal portion of a surface wave antenna, such as on conductive elements 103 and 104 of antenna 100, and allow for ingress and egress of an electrically conductive structure into the interior of the antenna. Furthermore, the dielectric fill material could allow for altered receive and transmit characteristics of surface waves over an electrically conductive structure, such as modifying a gain level, surface wave attachment characteristics, changing a noise level, or other characteristics. Examples of dielectric fill material include solid foam, gel, wood, aerogel, or other materials.

Figure 4:
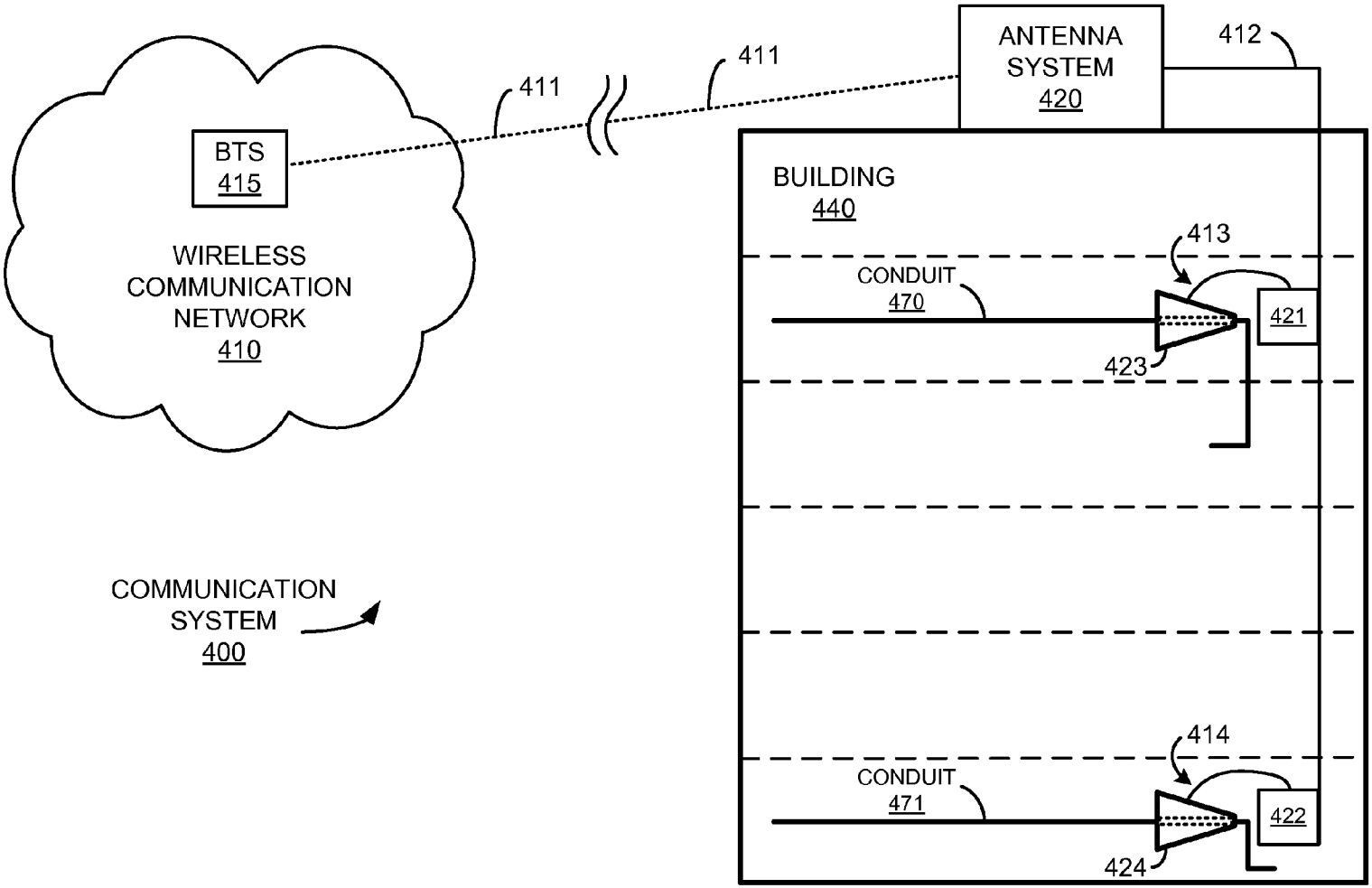
FIG. 4 is a system diagram illustrating a communication system.

FIG. 4 is a system diagram illustrating communication system 400. Communication system 400 includes wireless communication network 410, antenna system 420, transceivers 421-422, surface wave antennas 423-424, conduits 470-471, and building 440. Wireless communication network 410 communicates with antenna system 420 through base transceiver station (BTS) 415 over wireless link 411. Antenna system 420 and transceivers 421-422 communicate over link 412. Transceivers 421-422 and surface wave antennas 423-424 communicate over radio-frequency (RF) links 413 and 414, respectively.

Wireless communication network 410 includes base transceiver station (BTS) 415. In some examples, BTS 415 is considered a donor or macro site for antenna system 420. Wireless communication network 410 also could include further base transceiver stations, base stations, base station controllers, radio node controllers (RNC), packet data serving nodes (PDSN), authentication, authorization, and accounting (AAA) equipment, home agents, data centers, mobile switching centers (MSC), call processing equipment, telephone switches, Internet routers, network gateways, as well as other type of communication equipment, including combinations thereof.

Base station transceiver (BTS) 415 includes equipment to exchange wireless communications to and from wireless communication network 410 over wireless link 411. BTS 415 could also include antennas, transceivers, and other equipment for communicating with and controlling wireless communication devices, such as mobile phones.

Antenna system 420 includes equipment to exchange the wireless communications of wireless link 411 over link 412 with transceivers 421-422. Antenna system 420 could also include further antennas, amplifiers, control interfaces, buffers, transmitters, receivers, signal processors, or other communication equipment and circuitry. Examples of antenna system 420 could include a distributed antenna system (DAS). A distributed antenna system (DAS) typically includes communication systems where base transceiver stations or access node equipment are located separately and distant from multiple antenna nodes serving a geographic area. In many of these DAS examples, the base transceiver station equipment desires to communicate over extended distances to separate antennas capable of communicating with wireless communication devices over wireless links.

Surface wave antennas 423-424 include antennas and equipment capable of exchanging communications with transceivers 421-422 over RF links 413-414, respectively. In this example, surface wave antennas 423-424 also transmit and receive surface wave RF communications over conduits 470-471, respectively. Surface wave antennas 423-424 may comprise the surface wave antennas as discussed in FIGS. 1A, 1B, 2, and 3, and may also include further antennas, antenna arrays, filtering equipment, other communications equipment, or combinations thereof.

Building 440 includes six floors, as indicated by the dashed horizontal lines in FIG. 4. In FIG. 4, building 440 has antenna system 420 located on the top portion, although in other examples antenna system 420 could be located at other locations in or around building 440. Also in this example, surface wave antenna 423 is located on the fifth floor of building 440, while surface wave antenna 424 is located on the first floor of building 440.

Wireless link 411 uses the code division multiple access (CDMA) communication protocol in this example, although other wireless protocols could be used, such as worldwide interoperability for microwave access (WiMAX), universal mobile telecommunications system (UMTS), long-term evolution (LTE), wireless fidelity (WiFi), global system for mobile communications (GSM), or some other communication format—including combinations, improvements, or variations thereof. In FIG. 4, wireless link 411 represents all wireless communications exchanged through BTS 415 between wireless communication network 410 and antenna system 420, which could include both forward link and reverse link portions. Wireless link 411 is illustrated as cropped in size for clarity in FIG. 4, as BTS 415 of wireless communication network 410 could be located a distance away from building 440.

In the example shown in FIG. 4, link 412 and RF links 413-414 include coaxial wire links. Link 412 carries communications between transceivers 421-422 and antenna system 420. Link 412 could include separate links for each of transceivers 421-422, or transfer all communications over a single link. RF links 413 414 carry wireless communications exchanged via surface waves over conduits 470-471, respectively. Other examples of RF links 413-414 could include waveguides to the respective surface wave antenna 423-424.

Communications transferred via surface waves over conduits 470 and 471 could be received by user devices, such as wireless communication devices, for communicating with wireless communication network 410. In other examples, two or more surface wave antennas could be coupled to the same conductive structure, such as conduit 470, where the surface wave communications over the conductive structure are used instead of coaxial wire or optical fiber interconnect between transceiver elements of an indoor distributed antenna system (DAS). Advantageously, existing conduits in building 440 could be used to extend the range of BTS 415 through the use of at least surface wave antennas 423-424. In some examples, building 440 can shield or attenuate the wireless signals of BTS 415 and degrade communications between wireless communication devices located in building 440 and BTS 415. Since conduits 470-471 penetrate into building 440, surface waves transferred by surface wave antennas 423-424 can ride along generally straight potions of conduits 470-471 to extend the wireless range of BTS 415. Likewise, wireless communications received over conduits 470-471 by surface wave antennas 423-424 from wireless communication devices located in building 440 can be transferred through antenna system 420 for receipt by BTS 415. It should be noted that conduits 470-471 could include bends, turns, or angled portions. In some examples, additional surface wave antennas can be utilized to transfer a surface wave around a bend, turn, or angled portion. For example, a first surface wave antenna could be placed prior to a bend and an additional surface wave antenna placed after the bend.

FIGS. 1-4 and the previous descriptions depict specific embodiments to teach those skilled in the art how to make and use the best mode. For the purpose of teaching inventive principles, some conventional aspects have been simplified or omitted. Those skilled in the art will appreciate variations from these embodiments that fall within the scope of the invention. Those skilled in the art will also appreciate that the features described above can be combined in various ways to form multiple embodiments. As a result, the invention is not limited to the specific embodiments described above, but only by the claims and their equivalents.

What is claimed is:

1. A surface wave antenna configured to install on an existing electrically conductive structure, the surface wave antenna comprising:

a first portion of the surface wave antenna comprising a conductive element and an attachment element;

a second portion of the surface wave antenna comprising a conductive element and an attachment element;

wherein the conductive element of the first portion and the conductive element of the second portion are configured to each form a conductive longitudinal portion of a horn receive element, and wherein the attachment element of the first portion and the attachment element of the second portion are configured to conductively couple the conductive element of the first portion to the conductive element of the second portion to form the horn receive element;

a dipole element comprising a first transmit element and a second transmit element, wherein the first transmit element is coupled by a first dielectric member internally to the first portion of the surface wave antenna and the second transmit element is coupled by a second dielectric member internally to the second portion of the surface wave antenna; and a mounting element comprising a first dielectric mount and a second dielectric mount, wherein the first dielectric mount is disposed internally to and radially from the conductive element of the first portion and the second dielectric mount is disposed internally to and radially from the conductive element of the second portion.

2. The surface wave antenna of claim 1, wherein the surface wave horn receive element comprises an opening at opposing longitudinal ends, and wherein the mounting element is configured to attach the horn receive element to the electrically conductive structure disposed axially through the center of the horn receive element.

3. The surface wave antenna of claim 2, wherein the horn receive element is electrically isolated from the conductor when the horn receive element is attached to the electrically conductive structure by the mounting element.

4. The surface wave antenna of claim 2, wherein the first transmit element and the second transmit element are electrically isolated from the electrically conductive structure when the horn receive element is attached to the conductor.

5. The surface wave antenna of claim 1, wherein the first dielectric mount and the second dielectric mount each penetrate the horn receive element through a radial hole in the horn receive element, and wherein the first dielectric mount and the second dielectric mount are coupled to the horn receive element.

6. The surface wave antenna of claim 5, wherein each radial hole comprises a threaded radial hole, and wherein the first dielectric mount and the second dielectric mount are each configured to screw through the associated radial hole on the horn receive element to adjust a firmness of the attachment of the horn receive element to the electrically conductive structure.

7. The surface wave antenna of claim 2, wherein the mounting element further comprises a tightening portion coupled to at least one of the first dielectric mount and the second dielectric mount to adjust a firmness of the attachment of the horn receive element to the electrically conductive structure.

8. The surface wave antenna of claim 1, wherein the first portion and the second portion each have a first longitudinal edge and a second longitudinal edge, and wherein the first portion and the second portion are pivotally coupled along each first longitudinal edge by each attachment element to enable ingress of the electrically conductive structure to dispose the electrically conductive structure axially through the center of the horn receive element.

9. The surface wave antenna of claim 8, wherein the attachment element of the first portion and the attachment element of the second portion each further comprise a fastener disposed along each second longitudinal edge.

10. The surface wave antenna of claim 9, wherein the first portion and the second portion are configured to be coupled to each other along each second longitudinal edge by the fastener after ingress of the electrically conductive structure.

11. The surface wave antenna of claim 1, further comprising:

an input conductor coupled to each of the first transmit element and the second transmit element of the dipole element, and wherein the first transmit element and the second transmit element are configured to receive radio-frequency (RF) signals over the associated input conductor for transmission of surface wave RF signals along the electrically conductive structure.

12. The surface wave antenna of claim 11, wherein each input conductor is terminated at an input jack, wherein the input jack is dielectrically coupled to the horn receive element.

13. The surface wave antenna of claim 11, wherein the first dielectric mount and the second dielectric mount of the mounting element penetrate the horn receive element, and wherein the first dielectric mount and the second dielectric mount are coupled to the horn receive element, and wherein each input conductor is routed through a hollow portion internal to the associated dielectric mount to reach the first transmit element and the second transmit element of the dipole element.

14. The surface wave antenna of claim 1, further comprising:

an output jack coupled to the horn receive element, and wherein the horn receive element is configured to receive surface wave radio-frequency (RF) signals over the electrically conductive structure for exchange with the output jack.

15. The surface wave antenna of claim 1, wherein the horn receive element comprises a central hollow cavity, and wherein the dipole element and the mount element are disposed internally to the central hollow cavity.

16. The surface wave antenna of claim 15, wherein the central hollow cavity of the horn receive element is filled with a dielectric material.

17. The surface wave antenna of claim 16, wherein the dipole element and the mount element are embedded within the dielectric material.

18. The surface wave antenna of claim 1, wherein the first transmit element is coupled to the first dielectric mount and the second transmit element is couple to the second dielectric mount.

19. A surface wave antenna configured to install on an electrically conductive structure, the surface wave antenna comprising:

a first portion of the surface wave antenna comprising a conductive element and an attachment element;

a second portion of the surface wave antenna comprising a conductive element and an attachment element;

wherein the conductive element of the first portion and the conductive element of the second portion are configured to each form a conductive longitudinal portion of a horn receive element, and wherein the attachment element of the first portion and the attachment element of the second portion are configured to conductively couple the conductive element of the first portion to the conductive element of the second portion to form the horn receive element;

a dipole transmit element coupled by a dielectric member internally to the surface wave antenna; and a mounting element disposed internally to the horn receive element, wherein the mounting element is configured to attach the surface wave antenna to the electrically conductive structure, wherein the electrically conductive structure is disposed axially through the horn receive element, and wherein the mounting element is further configured to electrically isolate the horn receive element and the dipole transmit element from the electrically conductive structure.

20. A surface wave antenna configured to install on an electrically conductive structure, the surface wave antenna comprising:

a first portion of the surface wave antenna comprising a conductive element and an attachment element;

a second portion of the surface wave antenna comprising a conductive element and an attachment element;

wherein the conductive element of the first portion and the conductive element of the second portion are configured to each form a conductive longitudinal portion of a horn receive element, and wherein the attachment element of the first portion and the attachment element of the second portion are configured to conductively couple the conductive element of the first portion to the conductive element of the second portion to form the horn receive element;

a dipole transmit element coupled by a dielectric member internally to the surface wave antenna;

a mounting element disposed internally to the horn receive element, wherein the mounting element is configured to attach the surface wave antenna to the electrically conductive structure, wherein the electrically conductive structure is disposed axially through the horn receive element, and wherein the mounting element is further configured to electrically isolate the horn receive element and the dipole transmit element from the electrically conductive structure;

an input jack coupled to the dipole transmit element, wherein the dipole transmit element is configured to receive radio-frequency (RF) signals over the input jack from a transceiver for transmission of surface wave RF signals along the electrically conductive structure; and an output jack coupled to the horn receive element, wherein the horn receive element is configured to receive further surface wave RF signals over the electrically conductive structure for transfer to the transceiver over the output jack.

* * * * *